US011538647B2

(12) United States Patent
Huang et al.

(10) Patent No.: US 11,538,647 B2
(45) Date of Patent: Dec. 27, 2022

(54) ELECTROMAGNETIC RELAY

(71) Applicant: Tyco Electronics (Shenzhen) Co. Ltd., Shenzhen (CN)

(72) Inventors: Zhihong Huang, Shenzhen (CN); Kun Tang, Shenzhen (CN); Zhenxing Fu, Shenzhen (CN)

(73) Assignee: Tyco Electronics (Shenzhen) Co. Ltd., Shenzhen (CN)

( * ) Notice: Subject to any disclaimer, the term of this patent is extended or adjusted under 35 U.S.C. 154(b) by 280 days.

(21) Appl. No.: 16/587,465

(22) Filed: Sep. 30, 2019

(65) Prior Publication Data

US 2020/0105487 A1 Apr. 2, 2020

(30) Foreign Application Priority Data

Sep. 30, 2018 (CN) ..... 201811154749.6

(51) Int. Cl.

| | |
|---|---|
| ***H01H 63/02*** | (2006.01) |
| ***H01H 50/36*** | (2006.01) |
| ***H01H 50/14*** | (2006.01) |
| ***H01H 50/64*** | (2006.01) |

(52) U.S. Cl.

CPC ..... *H01H 50/36* (2013.01); *H01H 50/14* (2013.01); *H01H 50/64* (2013.01); *H01H 2205/002* (2013.01)

(58) Field of Classification Search

CPC ..... H01H 50/44; H01H 50/02; H01H 50/18; H01H 50/36; H01H 51/06; H01H 50/042; H01H 50/642; H01H 2050/367; H01H 50/58

USPC ..... 335/133

See application file for complete search history.

(56) References Cited

U.S. PATENT DOCUMENTS

| | | | | | |
|---|---|---|---|---|---|
| 4,346,359 | A * | 8/1982 | Pirner | H01H 51/06 | 335/202 |
| 5,160,910 | A * | 11/1992 | Tsuji | H01H 50/642 | 335/121 |
| 5,204,647 | A * | 4/1993 | Mitsuki | H01H 50/043 | 335/128 |
| 5,289,145 | A * | 2/1994 | Schedele | H01H 50/026 | 335/128 |
| 5,392,015 | A * | 2/1995 | Matsuoka | H01H 1/50 | 335/130 |

(Continued)

FOREIGN PATENT DOCUMENTS

| | | | |
|---|---|---|---|
| JP | 200021280 | A | 1/2000 |
| JP | 2005183083 | A | 7/2005 |

OTHER PUBLICATIONS

Abstract of JP 2005183083, dated Jul. 7, 2005, 1 page.

*Primary Examiner* — Bernard Rojas
*Assistant Examiner* — Lisa N Homza
(74) *Attorney, Agent, or Firm* — Barley Snyder

(57) ABSTRACT

An electromagnetic relay includes a base, a spool provided on the base, a coil wound on the spool, a yoke inserted into a hole formed in the spool, an armature movably disposed on the base, a movable contact fixed on the base, a static contact fixed on the base, a driving member connected between the armature and the movable contact, and an elastic pressing member fixed on the base. The elastic pressing member is pressed against an outer side of the armature so as to position the armature on the base and provide an auxiliary thrust to the armature.

21 Claims, 3 Drawing Sheets

(56) References Cited

U.S. PATENT DOCUMENTS 5,396,204 A * 3/1995 Matsuoka ..... H01H 50/04 335/78
5,572,176 A * 11/1996 Heinzl ..... H01H 50/642 335/129
5,719,541 A * 2/1998 Mader ..... H01H 50/642 335/78
5,781,089 A * 7/1998 Doneghue ..... H01H 50/026 335/78
5,790,004 A * 8/1998 Matsuoka ..... H01H 50/042 335/78
6,232,858 B1 * 5/2001 Reiter ..... H01H 50/18 335/128
6,496,090 B1 * 12/2002 Nishida ..... H01H 50/023 335/128
6,545,575 B1 * 4/2003 Hirabayashi ..... H01H 50/042 335/128
7,782,162 B2 * 8/2010 Nishida ..... H01H 50/56 335/201
8,111,117 B2 * 2/2012 Minowa ..... H01H 50/34 335/78
8,816,800 B2 * 8/2014 Mikl ..... H01H 50/64 335/83
9,076,617 B2 * 7/2015 Yamashita ..... H01H 9/443
9,159,513 B2 * 10/2015 Moriyama ..... H01H 50/026
9,754,747 B1 * 9/2017 Yeh ..... H01H 50/047
11,004,639 B2 * 5/2021 Wu ..... H01H 50/643
2002/0109569 A1 * 8/2002 Yamashita ..... H01H 50/443 335/129
2005/0151606 A1 * 7/2005 Nishida ..... H01H 9/443 335/128
2006/0091985 A1 * 5/2006 Mochizuki ..... H01H 50/54 335/128
2006/0181380 A1 * 8/2006 Nakamura ..... H01H 50/646 335/132
2008/0180197 A1 * 7/2008 Kubono ..... H01H 50/443 335/78
2010/0060396 A1 * 3/2010 Mikl ..... H01H 50/44 335/299
2012/0206223 A1 * 8/2012 Tan ..... H01H 51/2272 335/189
2016/0027602 A1 * 1/2016 Hasegawa ..... H01H 50/58 335/189
2018/0130625 A1 * 5/2018 Kubono ..... H01H 50/56
2018/0144895 A1 * 5/2018 Shimoda ..... H01H 50/06
2021/0159036 A1 * 5/2021 Ikushima ..... H01H 50/38
2021/0166904 A1 * 6/2021 Kato ..... H01H 50/36

* cited by examiner

ELECTROMAGNETIC RELAY

CROSS-REFERENCE TO RELATED APPLICATION

This application claims the benefit of the filing date under 35 U.S.C. § 119(a)-(d) of Chinese Patent Application No. 201811154749.6, filed on Sep. 30, 2018.

FIELD OF THE INVENTION

The present invention relates to a relay and, more particularly, to an electromagnetic relay.

BACKGROUND

An electromagnetic relay comprises a base, a spool fixed on the base, a coil wound around the spool, an iron core inserted into the coil, a yoke riveted to the iron core, and an armature connected between the yoke and the iron core. When the coil is energized, an electromagnetic loop is formed among the yoke, the armature, and the iron core, and the armature moves under the action of electromagnetic force, thus realizing the switching action of the electromagnetic relay.

The electromagnetic relay, however, includes too many components, which leads to a complex structure and low manufacturing efficiency. Moreover, because of the numerous components, excessive cumulative errors will result during assembly of the electromagnetic relay, which is not conducive to the consistency of the function of the final products. Further, because the armature is movably assembled onto the base, in order to prevent the armature from being detached from the base it is necessary to form a positioning feature to limit a movable range of the armature on an inner side wall of a housing of the electromagnetic relay. However, the housing is generally made of plastic, and the positioning feature thus is not reliable or stable.

SUMMARY

An electromagnetic relay includes a base, a spool provided on the base, a coil wound on the spool, a yoke inserted into a hole formed in the spool, an armature movably disposed on the base, a movable contact fixed on the base, a static contact fixed on the base, a driving member connected between the armature and the movable contact, and an elastic pressing member fixed on the base. The elastic pressing member is pressed against an outer side of the armature so as to position the armature on the base and provide an auxiliary thrust to the armature.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
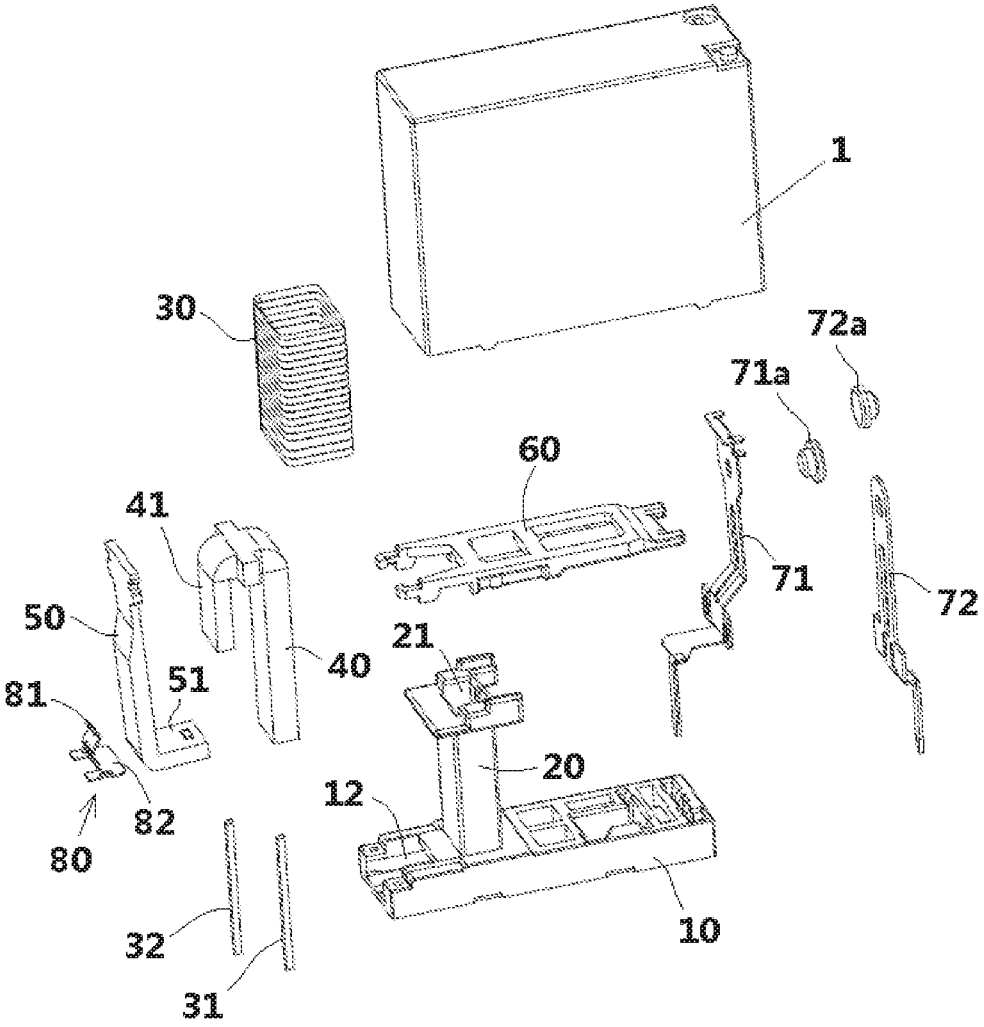
FIG. 1 is an exploded perspective view of an electromagnetic relay according to an embodiment.

The disclosure will be described hereinafter in further detail with reference to the following embodiments, taken in conjunction with the accompanying drawings. In the specification, the same or similar reference numerals indicate the same or similar parts. The description of the embodiments of the disclosure hereinafter with reference to the accompanying drawings is intended to explain the general inventive concept of the disclosure and should not be construed as a limitation on the disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

Figure 2:
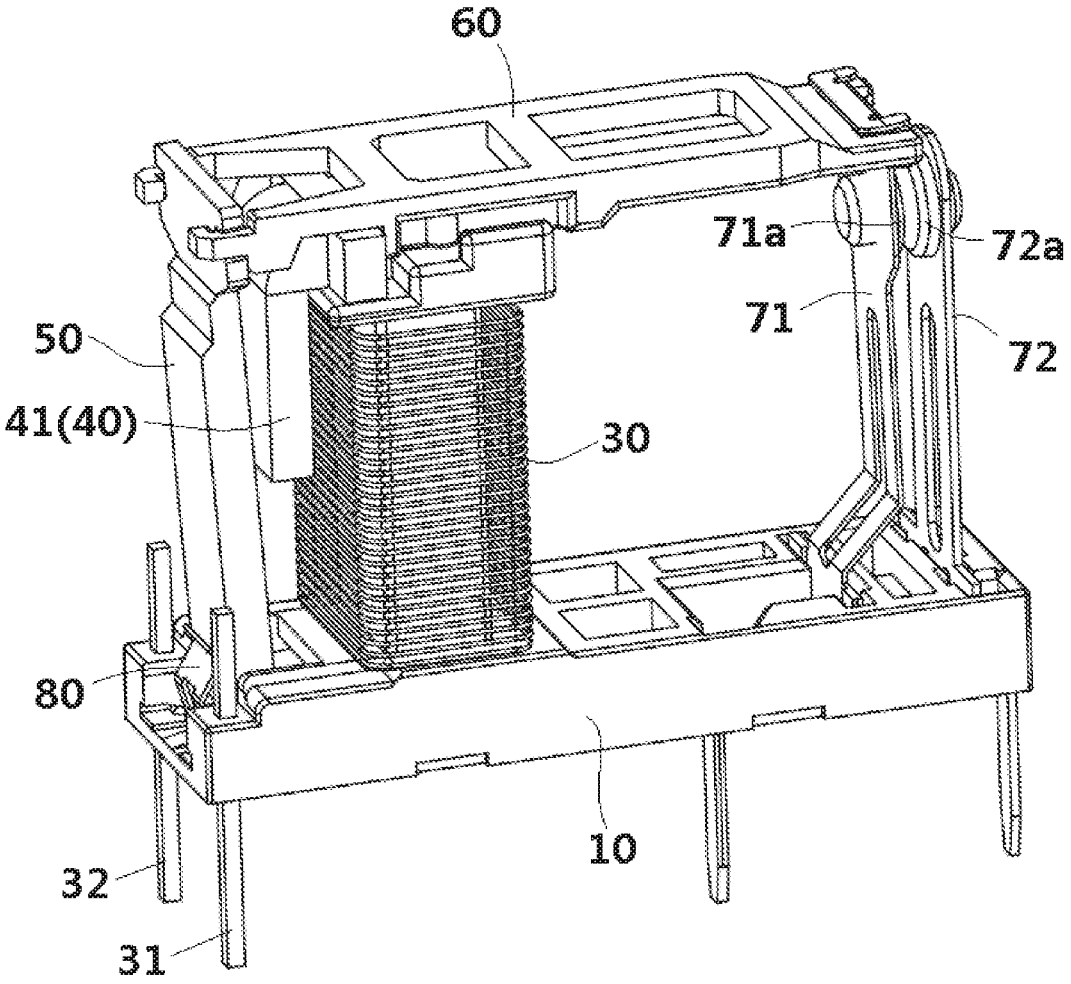
FIG. 2 is a perspective view of the electromagnetic relay.
Figure 3:
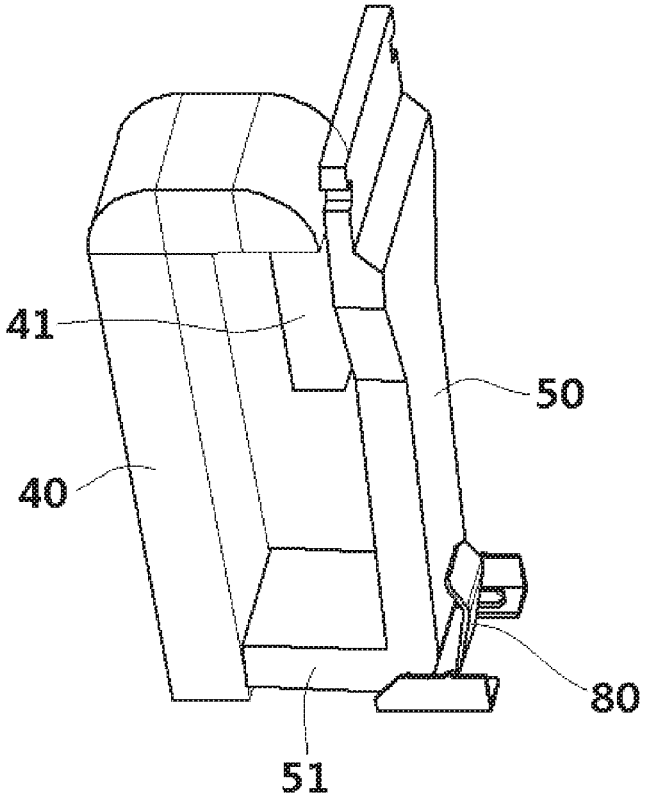
FIG. 3 is a perspective view of a yoke, an armature, and an elastic pressing member of the electromagnetic relay.

An electromagnetic relay according to an embodiment, as shown in FIGS. 1-3, comprises a base 10, a spool 20 provided on the base 10, a coil 30 wound on the spool 20, a yoke 40 inserted into a hole 21 formed in the spool 20, an armature 50 movably disposed on the base 10, a movable contact 71, 71*a* fixed on the base 10, a static contact 72, 72*a* fixed on the base 10, and a driving member 60 connected between the armature 50 and the movable contact 71, 71*a*.

The electromagnetic relay, as shown in FIGS. 1-3, comprises an elastic pressing member 80 fixed on the base 10 and pressed against an outer side of the armature 50 so as to position the armature 50 on the base 10 and to provide an auxiliary thrust to the armature 50. The elastic pressing member 80 has a base part 82 adapted to be fixed on the base 10 and an elastic sheet 81 connected to the base part 82 and elastically pressed against the outer side of the armature 50.

The armature 50, as shown in FIGS. 1-3, has a main body and a lower end portion 51 bent 90 degrees relative to the main body so that the armature 50 is L-shaped. An end of the base 10 adjacent to the spool 20 has a receiving slot 12 into which the lower end portion 51 of the armature 50 is received. The lower end portion 51 of the armature 50 is supported on the base part 82 of the elastic pressing member 80, and the base part 82 of the elastic pressing member 80 is fixed into the receiving slot 12 of the base 10 in an interference fit manner. The lower end portion 51 of the armature 50 does not move to the outside of the receiving slot 12 due to being restricted and blocked by the elastic pressing member 80 on the outer side of the armature 50, so that the armature 50 may be reliably positioned in the receiving slot 12.

The elastic pressing member 80 exerts an auxiliary thrust on the armature 50, and the auxiliary thrust may cooperate with a magnetic force acting on the armature 50 to urge the armature 50 to swing, so that a magnetic force needed to drive the armature 50 to swing is reduced.

The yoke 40, as shown in FIGS. 1-3, has a main body and an upper end portion 41 bent 180 degrees relative to the main body so that the yoke 40 is U-shaped. The upper end portion 41 of the yoke 40 is arranged to face an upper end portion of the armature 50, and the lower end portion 51 of the armature 50 is arranged to face a lower end portion of the yoke 40, so that an annular magnetic loop is formed by the yoke 40 and the armature 50. The main body of the yoke 40 is inserted into the hole 21 of the spool 20, and the upper end portion 41 of the yoke 40 is located outside the spool 20.

When the coil 30 is energized, the driving member 60 is driven to move by the armature 50 under the magnetic force, and the movable contact 71, 71*a* is urged by the driving member 60 to move toward the static contact 72, 72*a*, so that the movable contact 71, 71*a* is brought into electrical contact with the static contact 72, 72*a*. When the coil 30 is de-energized, the magnetic force acting on the armature 50 disappears, the movable contact 71,71*a* moves away from the static contact 72,72*a* under an elastic restoring force thereof, so that the movable contact 71, 71*a* is electrically separated from the static contact 72,72*a*.

In the shown embodiment, the base 10 and the spool 20 are formed as a single integral member. For example, in an exemplary embodiment, the base 10 and the spool 20 may be formed as a single injection molding component. Thus, it is not necessary to separately manufacture the base 10 and the spool 20, and the step of assembling the spool 20 to the base 10 is thus omitted.

As shown in FIGS. 1 and 2, the movable contact 71, 71*a* has a movable elastic sheet 71 and a movable contact point 71*a* provided on an upper end of the movable elastic sheet 71. A lower end of the movable elastic sheet 71 is inserted into the base 10. The static contact 72,72*a* has a static elastic sheet 72 and a static contact point 72*a* provided on an upper end of the static elastic sheet 72. A lower end of the static elastic sheet 72 is inserted into the base 10.

As shown in FIGS. 1 and 2, the upper end portion of the armature 50 is inserted into a slot formed in a first end of the driving member 60, and a second end of the driving member 60 is inserted into a slot formed in the upper end of the movable elastic sheet 71. The driving member 60 is connected between the armature 50 and the movable elastic sheet 71. The movable contact point 71*a* is formed as a separate contact component mounted on the movable elastic sheet 71, and the static contact point 72*a* is a separate contact component mounted on the static elastic sheet 72. In other embodiments, however, the movable contact point 71*a* may be a protrusion integrally formed on the movable elastic sheet 71, and the static contact point 72*a* may be a protrusion integrally formed on the static elastic sheet 72.

The electromagnetic relay, as shown in FIGS. 1 and 2, comprises a pair of coil pins 31, 32 fixed on the base 10 and electrically connected to the coil 10 for electrically connecting the coil 10 to an external power supply.

The electromagnetic relay, as shown in FIG. 1, comprises a housing 1 adapted to be hermetically assembled onto the base 10. The coil 30, the yoke 40, the armature 50, the movable contact 71, 71*a*, the static contact 72, 72*a*, the driving member 60, and the elastic pressing member 80 are hermetically accommodated within the housing 1.

It should be appreciated by those skilled in this art that the above embodiments are intended to be illustrative, and many modifications may be made to the above embodiments by those skilled in this art, and various structures described in various embodiments may be freely combined with each other without conflicting in configuration or principle.

Although the disclosure has been described hereinbefore in detail with reference to the attached drawings, it should be appreciated that the disclosed embodiments in the attached drawings are intended to illustrate embodiments of the disclosure by way of example, and should not be construed as limitation to the disclosure.

Although several exemplary embodiments have been shown and described, it would be appreciated by those skilled in the art that various changes or modifications may be made to these embodiments without departing from the principles and spirit of the disclosure, the scope of which is defined by the claims and their equivalents.

What is claimed is:

1. An electromagnetic relay, comprising:

a base;

a spool provided on the base;

a coil wound on the spool;

a yoke inserted into a hole formed in the spool;

an armature movably disposed on the base;

a movable contact fixed on the base;

a static contact fixed on the base;

a driving member connected between the armature and the movable contact; and an elastic pressing member fixed on the base and pressed against an outer side of the armature so as to position the armature on the base and provide an auxiliary thrust to the armature urging the armature toward the coil.

2. The electromagnetic relay of claim 1, wherein the elastic pressing member has a base part fixed directly on the base and an elastic sheet connected to the base part and elastically pressed against the outer side of the armature.

3. The electromagnetic relay of claim 2, wherein the armature has a main body and a lower end portion bent perpendicularly relative to the main body of the armature so that the armature is L-shaped.

4. The electromagnetic relay of claim 3, wherein an end of the base adjacent to the spool has a receiving slot into which the lower end portion of the armature is received.

5. The electromagnetic relay of claim 4, wherein the lower end portion of the armature is supported on the base part of the elastic pressing member, the base part of the elastic pressing member is fixed in the receiving slot of the base in an interference fit manner.

6. The electromagnetic relay of claim 1, wherein the yoke has a main body and an upper end portion bent 180 degrees with respect to the main body of the yoke so that the yoke is U-shaped.

7. The electromagnetic relay of claim 6, wherein the upper end portion of the yoke faces an upper end portion of the armature, a lower end portion of the armature faces a lower end portion of the yoke, and an annular magnetic loop is formed by the yoke and the armature.

8. The electromagnetic relay of claim 6, wherein the main body of the yoke is inserted into the hole of the spool, and the upper end portion of the yoke is located outside the spool.

9. The electromagnetic relay of claim 1, wherein, when the coil is energized, the driving member is driven to move by the armature under a magnetic force and the movable contact is driven by the driving member to move toward the static contact so that the movable contact is brought into electrical contact with the static contact.

10. The electromagnetic relay of claim 9, wherein, when the coil is de-energized, the movable contact moves away from the static contact under an elastic restoring force of the movable contact and the movable contact is electrically separated from the static contact.

11. The electromagnetic relay of claim 9, wherein the auxiliary thrust reduces the magnetic force necessary to drive the armature to a position in which the movable contact is brought into electrical contact with the static contact.

12. The electromagnetic relay of claim 1, wherein the base and the spool are a single integral component.

13. The electromagnetic relay of claim 1, wherein the base and the spool are a single injection-molded component.

14. The electromagnetic relay of claim 1, wherein the movable contact has a movable elastic sheet and a movable contact point disposed on an upper end of the movable elastic sheet, a lower end of the movable elastic sheet is inserted into the base.

15. The electromagnetic relay of claim 14, wherein the static contact has a static elastic sheet and a static contact point disposed on an upper end of the static elastic sheet, a lower end of the static elastic sheet is inserted into the base.

16. The electromagnetic relay of claim 15, wherein an upper end portion of the armature is inserted into a slot in a first end of the driving member, a second end of the driving member is inserted into a slot in the upper end of the movable elastic sheet, the driving member is connected between the armature and the movable elastic sheet.

17. The electromagnetic relay of claim 15, wherein the movable contact point is a protrusion integrally formed on the movable elastic sheet or a separate contact component mounted on the movable elastic sheet, and the static contact point is a protrusion integrally formed on the static elastic sheet or a separate contact component mounted on the static elastic sheet.

18. The electromagnetic relay of claim 1, further comprising a housing hermetically assembled onto the base, the coil, the yoke, the armature, the movable contact, the static contact, the driving member and the elastic pressing member are hermetically accommodated within the housing.

19. An electromagnetic relay, comprising:

a base;

a spool provided on the base;

a coil wound on the spool;

a yoke inserted into a hole formed in the spool;

an armature movably disposed on the base and having a main body and a lower end portion bent perpendicularly relative to the main body of the armature so that the armature is L-shaped, an end of the base adjacent to the spool has a receiving slot into which the lower end portion of the armature is received;

a movable contact fixed on the base;

a static contact fixed on the base;

a driving member connected between the armature and the movable contact; and an elastic pressing member fixed on the base and pressed against an outer side of the armature so as to position the armature on the base and provide an auxiliary thrust to the armature urging the armature toward the coil, the elastic pressing member having a base part fixed on the base and an elastic sheet connected to the base part and elastically pressed against the outer side of the armature, wherein the lower end portion of the armature is supported on the base part of the elastic pressing member, the base part of the elastic pressing member is fixed in the receiving slot of the base in an interference fit manner.

20. An electromagnetic relay, comprising:

a base having a receiving slot formed on an end thereof, a spool provided on the base;

a coil wound on the spool;

a yoke inserted into a hole formed in the spool;

an armature movably disposed on the base and within the receiving slot;

a movable contact fixed on the base;

a static contact fixed on the base;

a driving member connected between the armature and the movable contact; and an elastic pressing member having a base part positioned within the receiving slot of the base and an elastic sheet pressed against an outer side of the armature so as to position the armature on the base and provide an auxiliary thrust to the armature urging the armature toward the coil.

21. The electromagnetic relay of claim 20, wherein the driving member defines a slot formed therethrough in a lateral direction transverse to a direction of motion of the driving member, the slot receiving laterally extending protrusions of a top portion of the yoke.

* * * * *